United States Patent [19]

Delin

[11] 4,011,778

[45] Mar. 15, 1977

[54] ADJUSTABLE WRENCH

[76] Inventor: Lars Magnus Delin, Strandvagen 37, S-182 62 Djursholm, Sweden

[22] Filed: June 19, 1975

[21] Appl. No.: 588,506

[30] Foreign Application Priority Data

June 24, 1974 Sweden ..... 7408269

[52] U.S. Cl. ..... 81/186; 81/129

[51] Int. Cl.[2] ..... B25B 13/12

[58] Field of Search ..... 81/119, 170, 186

[56] References Cited

UNITED STATES PATENTS

| | | | |
|---|---|---|---|
| 852,071 | 4/1907 | Meyers, Jr. | 81/186 |
| 2,692,523 | 10/1954 | Finn | 81/170 X |
| 3,290,970 | 12/1966 | DeLucia | 81/186 X |
| 3,955,450 | 5/1976 | Evans | 81/170 |

FOREIGN PATENTS OR APPLICATIONS

| | | | |
|---|---|---|---|
| 1,072,636 | 9/1954 | France | 81/170 |

*Primary Examiner*—Al Lawrence Smith
*Assistant Examiner*—James G. Smith
*Attorney, Agent, or Firm*—Hill, Gross, Simpson, Van Santen, Steadman, Chiara & Simpson

[57] ABSTRACT

An adjustable wrench having two jaws movable in relation to one another. Each jaw having one short wrenching face and an adjacent longer wrenching face. The short wrenching faces engaging diametrically opposite sides of a nut and the longer wrenching faces engaging diametrically opposite sides of a nut. A recess is cut into one jaw to accommodate the longer wrenching face of the other jaw.

2 Claims, 1 Drawing Figure

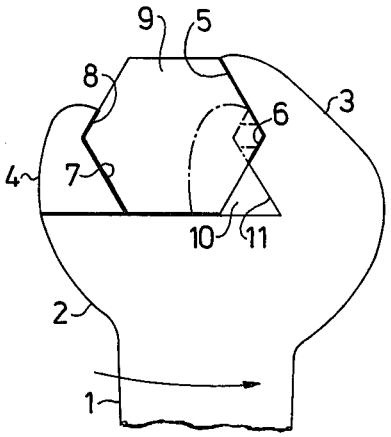
9
5
8
3
6
4
7
10
11
2
1

ADJUSTABLE WRENCH

BACKGROUND OF THE INVENTION

1. Field of the Invention

The present invention is related to an adjustable cresent wrench, namely a wrench comprising a jaw rigidly connected to a wrench handle and a jaw movable in relation to said rigid jaw which, by means of a screw arrangement, is displaceable toward and away from the rigid jaw.

2. Prior Art:

Commonly used adjustable wrenches of the type in question have a nut-engaging face on each jaw, said faces being parallel and adapted to engage two opposite, parallel faces on a nut. One disadvantage with these adjustable wrenches is that a relatively low torque may be applied before the nut is deformed so much that the adjustable wrench slips. For this reason, inter alia, rigid wrenches such as box wrenches, socket wrenches and the like are used if the torque is high. Since the number of various nut sizes is large, wrench sets having many different wrench sizes are required.

SUMMARY OF THE INVENTION

It is for this reason that there has long existed a need for a tool which combines the advantage of the adjustability of the adjustable wrench and the consequent applicability to a number of different nut sizes with the capability of the rigid wrenches of applying a greater torque to the nut.

The purpose of the present invention is to achieve an adjustable wrench which combines the above advantages of the known wrenches and which in many if not all cases can replace a number of rigid wrenches.

This result is achieved, according to the invention, in that each of the jaws has two faces which form a 120° angle with one another and are adapted to engage adjacent faces on a nut, the faces of the two jaws being arranged pairwise in parallel.

Through the construction according to the invention the adjustable wrench can engage two pairs of opposing faces on a hexagonal nut, and for a given deformation of the nut the wrench can transmit twice as much torque as a conventional adjustable wrench.

So as not to limit the usability of the adjustable wrench for nuts which are quite small in relation to the largest nut for which the wrench can be used, in a preferred embodiment of the invention, one jaw is shorter than the other. Also one of the jaws has a 60° recess extending across its root section into which a full thickness part of the root section of the other jaw can be inserted when one jaw is displaced towards the other. When the wrench is used on a nut having the greatest dimension, the outer face of the shorter jaw only engages a smaller part of the face of the nut. This, fact however, has no negative consequences if the length of the wrench face is at least approximately one-third of the nut face. The fact is that it is primarily the forward third of the nut face, seen in the direction of rotation, to which the force from the wrench is applied when turning the nut. When said length relationship is 1:3, the relation between the largest and the smallest nut is 6:1 and, for practical reasons, a larger gripping range is not usable for a given wrench size.

ON THE DRAWING

The invention is described in detail with reference to an embodiment shown on the attached drawing, in which the figure shows a schematic lateral view of a part of an adjustable wrench according to the invention.

AS SHOWN ON THE DRAWING

The adjustable wrench according to the invention has a head 2 integral with a handle 1, which head simultaneously forms a rigid jaw 3. A jaw 4 is movably mounted in the head 2 so as to be displaceable toward and away from the rigid jaw 3 by per se known means. The means for achieving the displacement of the movable jaw are not shown since they do not comprise a part of the invention itself, but they may be advantageously formed by a screw rotatably journalled in the head 2 and a rack rigidly connected with the movable jaw 4 and engaging the threads of the screw, i.e. the common arrangement in known adjustable wrenches.

The rigid jaw 3 has two faces 5,6 which form a 120° angle with one another and the jaw 4 has two corresponding faces 7,8. In the drawing the jaws are shown engaging a nut 9 (shown with solid lines). The faces 5 and 7 on the jaws 3 and 4, respectively, are parallel to one another as are the faces 6 and 8, so that the jaws engage two pairs of opposing, parallel lateral faces on the nut 9. In the drawing the adjustable wrench is adapted to be turned counter-clockwise, whereby two couples of forces acting on the nut are obtained in accordance with the described embodiment, permitting a large torque without the risk of the adjustable wrench slipping.

As may be seen from the drawing, the movable jaw 4 is made shorter than the rigid jaw 3, the latter having a V-shaped recess 10 in its root section. The recess 10 has a face parallel to the lower face 7 of the movable jaw 4. As a result of this construction the movable jaw 4 may be moved quite close to the rigid jaw 3, the former engaging the face 5 of the latter with its tip and the face 11 of the recess 10 with its face 7. In this position, shown with the dot-dash line, the adjustable wrench can grip nuts which are quite small in relation to the largest nut size for which the wrench can be used, which size is determined by the length of the face 7. In the illustrated embodiment the length of the face 8 is one-third the length of the face 7 and the relation between the largest and smallest nut is then 6:1.

I claim:

1. An adjustable wrench, comprising in combination:

a. a handle;

b. a rigid jaw integral with said handle and a slidable jaw adjustably carried on said handle;

c. each of said jaws having a first longer wrenching face and an adjacent second shorter wrenching face, 1. said wrenching faces of both jaws intersecting each other at an angle of 120° for simultaneously engaging two adjacent sides of a hexagonal nut,
2. said first wrenching faces being engageable with diametrically opposite sides of the nut, and engaging along the entire sides of the nut, said second wrenching faces being engageable with diametrically opposite sides of the nut,
3. the distal end of said movable jaw having an extent from said angle which is less than the length of its said first wrenching face, 4. the root of said rigid jaw having a transverse recess extending therethrough between said second shorter wrenching face of said rigid jaw and said handle, and 5. said first wrenching face of said movable jaw being receivable in said transverse recess along the entire width of said first wrenching face.

2. A wrench according to claim 1, said second wrenching face on said slidable jaw having a length which is at least one-third the length of the adjacent first wrenching face.

* * * * *